US009019680B2

(12) United States Patent
Hierl et al.

(10) Patent No.: US 9,019,680 B2
(45) Date of Patent: Apr. 28, 2015

(54) HORN SPARK GAP WITH A DEION CHAMBER

(75) Inventors: Stephan Hierl, Neumarkt (DE); Uwe Strangfeld, Nürnberg (DE); Arnd Ehrhardt, Neumarkt (DE); Stefanie Schreiter, Neumarkt (DE)

(73) Assignee: DEHN + SÖHNE GmbH + Co. KG, Neumarkt (DE)

( * ) Notice: Subject to any disclaimer, the term of this patent is extended or adjusted under 35 U.S.C. 154(b) by 292 days.

(21) Appl. No.: 13/813,461

(22) PCT Filed: Jun. 14, 2011

(86) PCT No.: PCT/EP2011/059805

§ 371 (c)(1),
(2), (4) Date: Apr. 24, 2013

(87) PCT Pub. No.: WO2012/016743

PCT Pub. Date: Feb. 9, 2012

(65) Prior Publication Data

US 2013/0235502 A1 Sep. 12, 2013

(30) Foreign Application Priority Data

Aug. 4, 2010 (DE) ..... 10 2010 033 294
May 23, 2011 (DE) ..... 10 2011 102 257

(51) Int. Cl.
*H01T 4/14* (2006.01)

(52) U.S. Cl.
CPC ..... *H01T 4/14* (2013.01)

(58) Field of Classification Search
CPC ..... H01T 4/14
USPC ..... 361/137
See application file for complete search history.

(56) References Cited

U.S. PATENT DOCUMENTS 3,611,007 A * 10/1971 Miske, Jr. ..... 315/36
5,754,385 A * 5/1998 Altmaier et al. ..... 361/118
2006/0104003 A1* 5/2006 Gautier ..... 361/120

FOREIGN PATENT DOCUMENTS

DE 102005015401 7/2006 ..... H01T 4/14
EP 0706245 4/1996 ..... H01T 4/14
EP 1829176 9/2007 ..... H01T 1/12
EP 1914850 4/2008 ..... H01T 4/14

OTHER PUBLICATIONS

The International Search Report, in English, dated Sep. 15, 2011, the Written Opinion of the International Searching Authority, in English, dated Feb. 4, 2013, the Notification Concerning Transmittal of International Preliminary Report on Patentability (Chapter 1 of the Patent Cooperation Treaty), in English, dated Feb. 5, 2013 and the International Preliminary Report on Patentability, in English, dated Feb. 5, 2013, issued from Applicant's corresponding PCT Application No. PCT/EP2011/059805, filed on Jun. 14, 2011 by the World Intellectual Property Organization (WIPO).

* cited by examiner

*Primary Examiner* — Thienvu Tran
*Assistant Examiner* — Kevin J Comber
(74) *Attorney, Agent, or Firm* — Gerald T. Bodner

(57) ABSTRACT

The invention relates to a horn spark gap with a deion chamber (8) with a non-blowout design having a multi-part insulating housing as supporting and accommodating body for the horn electrodes (1, 2) and the deion chamber (8) and means for conducting the arc-induced gas flow, wherein the insulating housing is divided in the plane spanned by the horn electrodes and forms a first and a second half-shell. According to the invention, the horn electrodes (1, 2) have an asymmetrical form. The arc running region (11) between the electrodes is delimited in the direction of the deion chamber by a plate-shaped insulating material (20), wherein the plate-shaped insulating material (20) is inserted into a respective first shaped portion of the respective half-shell in a form-fitting manner. Furthermore, the first shaped portions accommodate a ferromagnetic deposit (21) of the arc running region (11).

11 Claims, 4 Drawing Sheets

HORN SPARK GAP WITH A DEION CHAMBER

Figure 1:
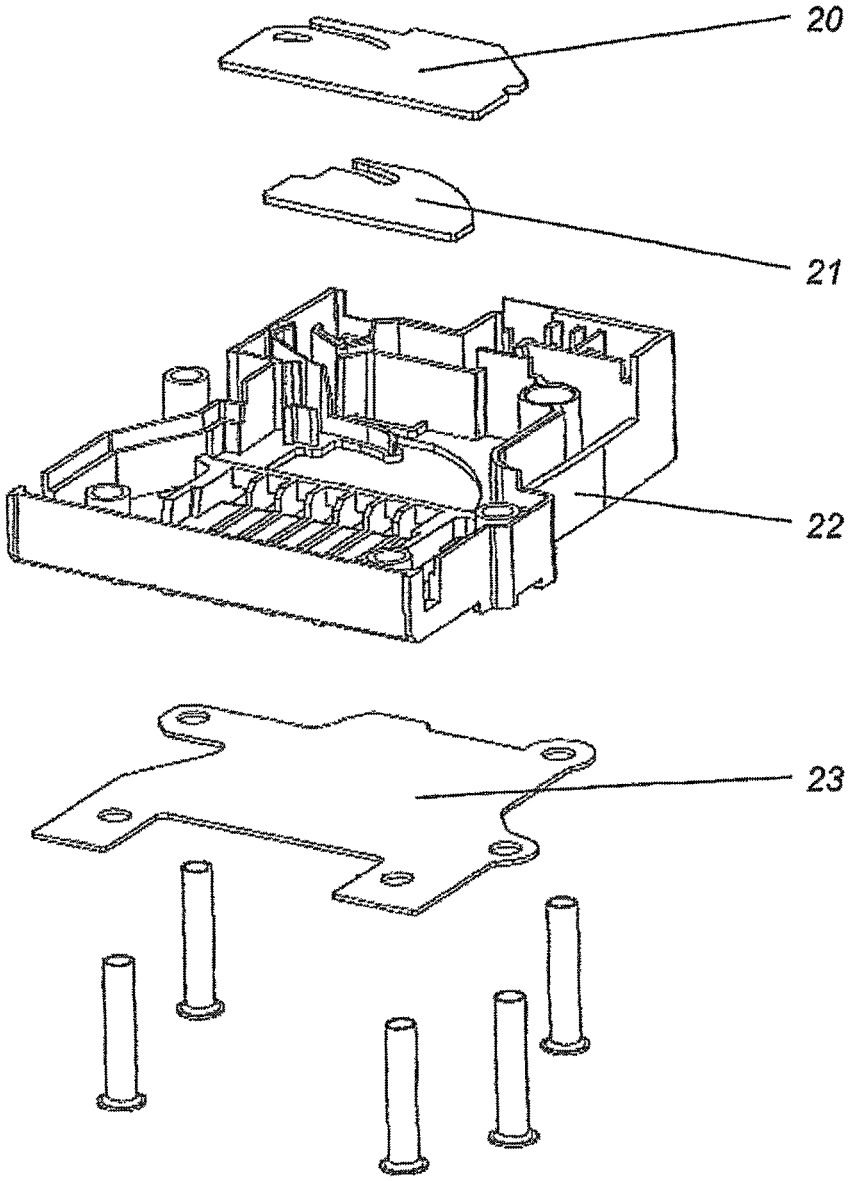

The invention relates to a horn spark gap with a deion chamber of a non-blowout design having a multi-part insulating housing as a supporting and accommodating body for the horn electrodes and the deion chamber as well as means for conducting the arc-induced gas flow, wherein the insulating housing is divided in the plane spanned by the horn electrodes and forms a first and a second half-shell in accordance with claim 1.

Horn spark gaps are known from EP 1 914 850 B1 and EP 1 829 176 B1, wherein the ionized gas blow-out effect is reduced.

According to EP 1 914 850 B1, the horn electrodes should be produced from an inexpensive material in order to reduce costs in producing such spark gaps.

EP 1 829 176 B1 moreover discloses a means for extending the isolating gap in case of overload.

Furthermore, solutions are known from prior art to include horn spark gaps and a non-hermetically sealed encapsulation, wherein the intrinsic magnetic field is supported in order to accelerate the arc movement in a targeted manner. The formation of channels for the internal targeted gas circulation for the purpose of cooling ionized gases is likewise known.

It has been shown that there is considerable pressure load in horn spark gaps, particularly in the case of load due to lightning pulse currents, so that the encapsulation and the materials used in same are to be subject to high requirements.

Due to the manner of realizing the internal circulation, the spark gap shown in DE 10 2005 015 401.8 has the disadvantage that the geometry and hence the quenching behavior of the deion chamber is essentially determined by the distance and geometry of the horn electrodes. A relatively free choice of the number and also the width of the deion chamber cannot be readily realized since the functionality of an encapsulation requires the targeted gas circulation shown there. This targeted circulation, however, is impaired when the arc travel path up to the deion chamber is no longer laterally sealed off against the backflow by the horn electrodes. In a required modification of the deion chamber, e.g. to increase the number of deion plates for a higher operating voltage, numerous parts would therefore have to be changed and the cost-intensive electrodes adapted.

From the aforementioned, it is thus the task of the invention to specify a further developed horn spark gap with a deion chamber of a non-blowout design having a multi-part insulating housing which can be configured to be cost-efficient, space-saving as well as modular and flexible with respect to its construction. The solution to be achieved is intended to allow the spark gap to be adapted to different performance parameters and different mains conditions and mains voltages by minimum modification of individual parts.

The solution to this task of the invention ensues from the feature combination according to claim 1, whereby the subclaims constitute no less than functional embodiments and further developments.

A horn spark gap with a deion chamber of a non-blowout design having a multi-part insulating housing as a supporting and accommodating means for the horn electrodes and the deion chamber as well as means for conducting the arc-induced gas flow are taken as a basis, wherein the insulating housing is divided in the plane spanned by the horn electrodes and forms a first and a second half-shell.

According to the invention, the horn electrodes have an asymmetrical form comprising a longer and a shorter electrode. In the ignition region, i.e. to the striking point and in a section downstream thereof, both electrodes extend almost in parallel or with an only very small divergence respectively widening.

The arc travel path between the electrodes is delimited in the direction of the deion chamber by a plate-shaped insulating material, wherein the plate-shaped insulating material is inserted into a respective first shaped portion of the respective half-shell in a form-fitting manner.

Furthermore, the first shaped portions accommodate a ferromagnetic deposit, preferably in a plate shape similarly formed as the arc travel path, wherein the plate-shaped insulating material electrically isolates the respective deposit from the electrodes.

The half-shells have further second shaped portions which fix a deion chamber part which can be inserted there in a form-fitting manner. Apertures or openings in the respective half-shell are located between the respective first and second shaped portions. The shorter of the electrodes ends in front of the deion chamber part, with the result that the gas flow only passes partially into the deion chamber.

According to the invention, the horn spark gap has a sandwich construction and the half-shells are joined by screws or rivets in a force-fitting manner.

The exterior sides of the half-shells facing away from the electrodes each have a third shaped portion at least in the area of the apertures or openings which accommodates an outer insulating plate in a form-fitting manner.

The third shaped portion in addition exhibits a web or a splitter for dividing the gas flow, wherein the section formed by the third shaped portion and the outer insulating plate creates a gas expansion space.

The gas expansion space in turn exhibits a preferably slit-shaped passage gap for conducting the gases back to the arc combustion chamber, wherein the electrodes have openings or flybacks above the ignition region to assist in the propelling of the arc by the gas flow.

The current supply to the longer electrode is guided so as to be antiparallel over a section as large as possible.

The shorter electrode exhibits high impedance.

The igniting or triggering of the horn spark gap ensues via a flexible circuit board having a conductor portion which is introduced into the ignition region between the electrodes.

In one configuration, the horn spark gap moreover has an error condition display having a shaped part spring-biased by the display which melts or becomes dimensionally unstable at excess temperature.

The outer insulating plate deforming upon pressure load can be embodied to be operatively connected to a sensor system for detecting abnormal operating states.

The spark gap according to the invention forms a universal module having exterior connecting terminals for the electrodes which can be integrated in a connector part or outer housing according to customer request.

All of the essential component assemblies such as the electrodes, the trigger electrode and/or the deion chamber are exchangeable and can be easily adapted to the respective mains conditions without departing from the basic construction of the horn spark gap according to the invention.

The integration of all the functional component assemblies into a compact unit without an outer housing already encapsulated per se, allows for the most diverse device implementations to be designed for various mains configurations in the simplest way possible. No additional components necessary for the function of the spark gap need to be realized within the actual device housing. Only wiring components, respectively communication terminals, need to be provided in the outer housing.

As stated above, the spark gap is composed of very simple individual parts which can be connected to each other by means of standard technologies, e.g. rivets. The spark gap functionality is already achieved by mounting the inner module without an outer housing. The mounting process may be realized by riveting.

The sandwich-like construction of large-surface single parts according to the invention results in a semi-elastic behavior of the entire construction when dynamic pressure loads are applied due to pulse currents. This enables simple and inexpensive materials to be used with the horn spark gap module having small overall dimensions as a whole.

Due to the gas conduction having several circulation circuits, almost all of the components are utilized for cooling the hot ionized gases. The horn electrodes manufactured as punched bent parts can be replaced, if needed, by electrodes of a material having a higher load-bearing capacity, if this is required by the spark gap's burn-off resistance at higher loads.

By exchanging the deion chamber, even higher operating voltages or short-circuit currents can be controlled. The replacing of the deion chamber with an insulating chamber or a deion chamber having an increased number of chamber plates can be very easily realized due to the configuration of the asymmetrical horn electrodes.

The error condition display by means of purely mechanically converting a limiting magnitude, in particular the temperature, is realized in a very space-saving manner and requires no additional energy.

All the functional components can be joined in a common assembly step, in particular riveting of the module.

One or more of the fully operational modules can be freely interconnected in a virtually freely selectable outer housing for any applications, mains types or even customer-specific design variants.

The invention will be explained in more detail below on the basis of an exemplary embodiment and with reference to the figures.

Figure 2:
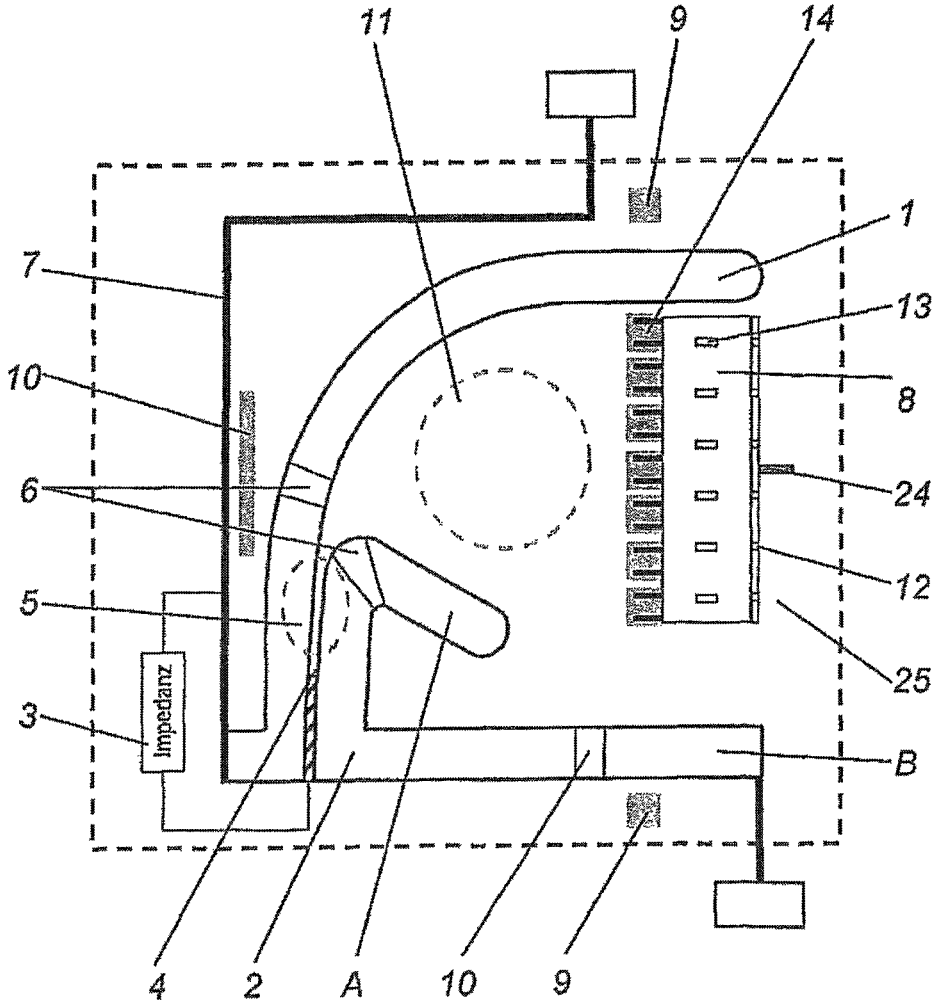
Figure 3:
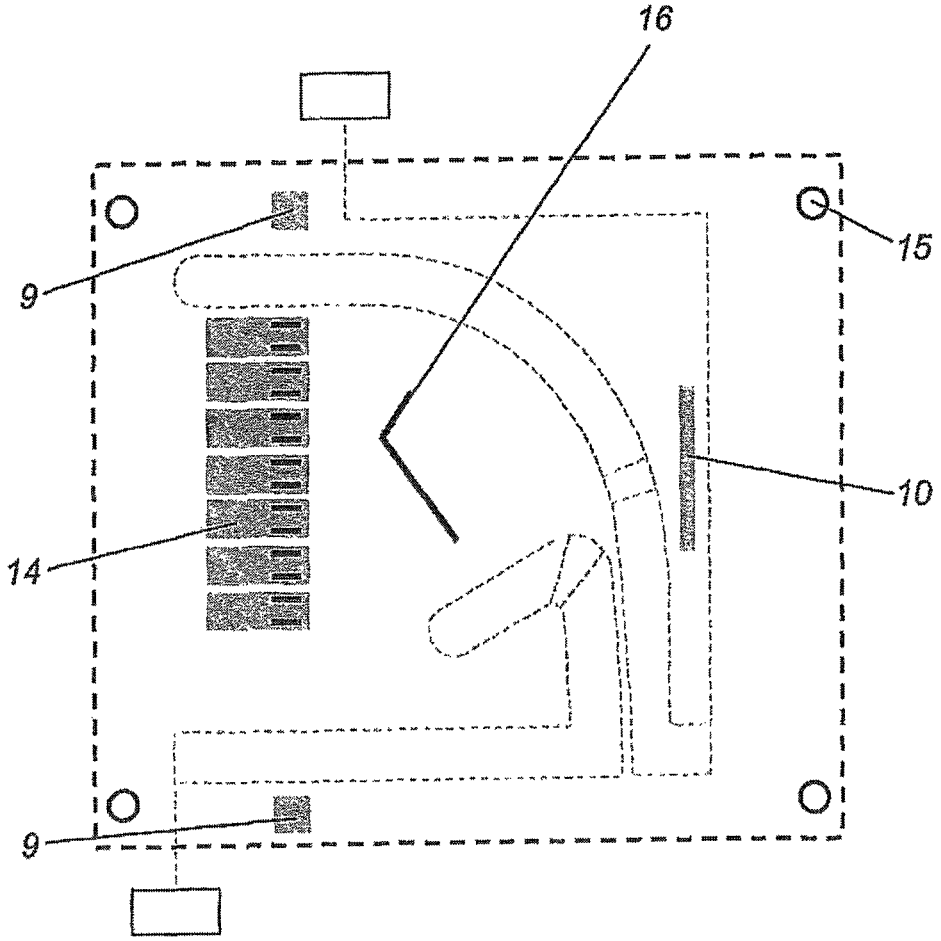
Figure 4:
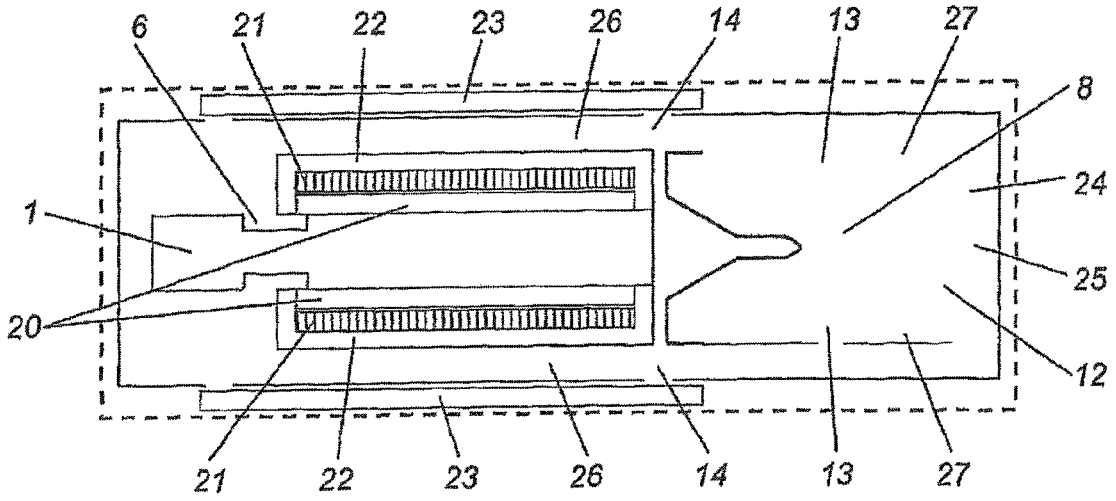

Shown are:

FIG. 1 a half-shell of the sandwich housing with insulating plates and ferromagnetic deposit;

FIG. 2 a schematic configuration of the spark gap including asymmetrical horn electrodes and a deion chamber;

FIG. 3 the outside of one of the half-shells in a top view with the position of the electrodes behind the housing outlined in dotted lines, and FIG. 4 a cross-section of the spark gap with the deion chamber and electrodes.

FIG. 1 shows one of the half-shells realized as a plastic molded part 22 including an outer insulating plate 23 e.g. formed as a vulcanized fiber plate. The ferromagnetic plate-shaped part 21, which will be covered by an inner vulcanized fiber plate 20, can likewise be recognized.

From the representation of half-shell 22, shaped portions adapted to the contour of the ferromagnetic material 21 are also apparent, same also holds true for the inner vulcanized fiber plate 20.

The recesses that can be recognized in the outer vulcanized fiber plate 23 receive rivets connecting the two half-shells of the housing with the elements contained in same.

The representation as per FIG. 2 allows the basic structure of the horn spark gap module to be recognized, the arc combustion chamber of which is characterized by two electrodes 1 and 2.

Electrode 1 is realized as a long electrode and electrode 2 as a short electrode.

The arc travel path of the electrodes 1 and 2 up to the arc quenching chamber, or deion chamber 8 respectively, is laterally delimited by burn off-resistant and only slightly gas-emitting insulating material (see FIG. 1), e.g. consisting of vulcanized fibers.

Such a vulcanized fiber plate can be manufactured as a simple, inexpensive punched plate. Because the fixing is via riveting, further connecting of the individual parts is not required.

The vulcanized fiber plate 20 moreover also fixes/insulates the ferromagnetic iron deposit 21 in each half-shell 22 as located in the arc travel path.

The iron deposits 21 are inserted and guided in the half-shell 22, but can also be directly injection-molded.

The respective half-shells 22 simultaneously realize the fixing of the electrodes 1 and 2 of the ignition aid located between the electrodes, the error condition display and the deion chamber 8.

In addition, the plastic molded part 22, respectively the corresponding half-shell, exhibits recesses and deflection means serving the purpose of guiding, distributing and returning the gases generated when the arc is striking. Baffle walls are realized as well, which serve the purpose of preventing metal or soot particles from being returned into the arc travel path in order to prevent re-ignitions from taking place or the insulation values from being degraded.

The aforementioned is particularly advantageous in reduced space conditions and at high loads.

The expansion spaces for the partially ionized gas are formed in each case between the half-shell part 22 and the outer insulating plate 23. These two plates also form the outer walls of the then already operable module at the same time and are riveted together with the other parts.

A simple technology for inserting parts in the plastic molding die or half-shell 22 enables different deion or arc quenching chambers for in turn integrating e.g. insulating web or meander chambers into the spark gap. Yet, it is also conceivable for an arc quenching chamber to be directly formed as an integral component during injection molding.

The ignition region between the electrodes is selected such that already quite high forces act upon the arc due to its intrinsic magnetic field, so that a rapid release of the arc from the ignition site and hence a rapid ignition of the spark gap will be ensured. The ignition site is some millimeters behind a parallel or only minimally divergent guideway of the two electrodes at a small spacing. A strong action of force results from the small spacing of the electrodes because of the current conductance.

The material of the ignition aid or the trigger electrode can be selected such that the initial arc movement is supported e.g. by gas emission. The initial movement can also be supported by already pre-bending the pilot arc in the travel direction e.g. by implementing protrusions.

In order to further increase the forces acting upon the arc, the connection of the long electrode 1 is guided to be antiparallel to said electrode 1 over a wide area.

The bilaterally inserted ferromagnetic deposits 21 in the side walls assist the desired rapid movement of the arc toward the arc quenching chamber 8. An additionally insulated ferromagnetic iron deposit of an electrode can be dispensed with in favor of the desired small size. Where appropriate, however, the material of the electrodes themselves can have ferromagnetic properties or a ferromagnetic core can be integrated into the electrode or the electrode itself can exhibit a sandwich construction.

The distance of the two electrodes 1 and 2 at the ignition site or in the ignition region 4 has an only very small divergence or extends virtually parallel over a length of several millimeters. This configuration of the main electrodes offers the advantage that a defined short circuit behavior of the spark gap can be realized without additional measures in the event of overload. Continuous overload of the electrodes can lead to the formation of a metal-induced gap which bridges the small distance between the two electrodes over a large area and in a manner capable of carrying current and then results in safely triggering an existing overcurrent protection device.

In order to produce high design freedom with respect to the configuration of the deion chamber, it is advantageous for the short electrode 2 to be allowed to terminate already in the area of the arc inlet. The arc will always tend to reduce its spark voltage, i.e. it must be forced to change the root from point A (tip) having an actually lower arc spark voltage to point B (lead) having a higher spark voltage.

The shorter horn electrode 2 shown in FIG. 2 needs to be led so far that not too many further deion plates remain unused due to the direct path to single deion plates, in order to exploit the entire performance of the deion chamber to the greatest extent possible.

A continuous arc root only at the short electrode 2 would be too close to the ignition region and lead to multiplied re-ignitions, respectively bridging of further plates below the deion chamber 8 in the inlet area. To achieve rapid and safe arc splitting in the entire deion chamber 8, the geometry and material of the short electrode as well as the lead thereof are designed for high impedance.

After the striking of the arc, a considerable voltage drop develops as a current flow which, apart from the arc extension, promotes a swift change of the arc root from the tip of the short electrode 2 (A) to the electrode lead (B). Steel is suited as an electrode or electrode lead material. To further improve the aforementioned effect, it is advantageous for the material of the lead or the electrode to be additionally heated when current is flowing, whereby the voltage drop is further increased. The arc voltage which can be achieved within the arc quenching chamber can be easily increased by several 10 V to 100 V by means of these measures with otherwise identical dimensions, whereby the use at higher operating voltages or improved current limitation becomes possible. To further gain space, the long electrode 1 can be realized in the area of the arc quenching chamber as a thin deflecting plate.

By using the shorter electrode 2 on one side and the thereby resulting asymmetrical configuration of the electrodes, the gas flow from the travel path is no longer fully driven into the arc quenching chamber (deion chamber) 8. Gases from the arc travel path can therefore already escape below the arc quenching chamber. This gas, as well, is utilized for the gas circulation through outflow openings 14 in the respective half-shell 22. Since the run-in time of the follow current arc into the arc quenching chamber only corresponds to a fraction of the total arc burning time, and the arc voltage is still low outside the deion chamber, i.e. no splitting into partial arcs has yet taken place, the gas only exhibits low energy. Also, the ionization of the gas is not yet too strong. The gas thus reaches sufficient cooling in contact with the electrode lead and the short electrode 2 so that it can be returned on a relatively short path.

Due to the quasi-withdrawal of gas below the deion chamber 8 via the cited openings, the flow resistance of the gas remaining in the deion chamber is simultaneously decreased. The reduction of the deion chamber's flow resistance leads to a faster entry of the arc into the chamber itself since reflections are reduced. Also, there is a faster arc splitting and hence a more efficient current limitation.

The reduction of the flow resistance can also be utilized to change the spacing of the deion plates within the deion chamber 8, i.e. to insert more plates or to further decrease the deion chamber dimensions in order to achieve a higher arc voltage at identical outer dimensions.

A circuit board 3 is used for the ignition of the spark gap with the horn electrodes 1 and 2. The circuit board 3 serves to fix the components required for the ignition process and simultaneously defines the ignition site 4 between the electrodes 1 and 2.

The necessary impedance for igniting can be formed by discrete structural elements or else by the circuit board material itself. With such a circuit board ignition aid, protection levels of below 1 kV can be realized.

The region 5 between the main electrodes 1 and 2 serves the purpose of dividing the functions between lightning surge currents and follow currents.

The recesses 6 in the electrodes 1 and 2 serve the purpose of returning the gases to the arc travel path and are located above the ignition region 5.

The connecting lead 7 of the long electrode 1 is led to be antiparallel to the respective electrode over a large area.

The long electrode 1 is led laterally to the arc quenching chamber, deion chamber 8 respectively.

The short electrode 2 already ends in the arc travel path 11 with the tip A. In a preferred functional mode, the root of the arc, after reaching position A, changes to position B on the connection area of electrode 2.

The gases which are conducted through the deion chamber 8, or withdrawn laterally from the deion chamber 8 after the arc splitting respectively, are led into an expansion area 26 for cooling via openings 9.

On the front side, the deion chamber has a central transverse web and a continuous longitudinal web by which gases are split and guided so as to prevent a one-sided load on the construction of the horn spark gap module as a whole.

The cooled and expanded gases are re-fed into the travel path 11 via openings 11 and recesses 6 in the electrodes 1 and 2.

In addition to the front openings 12 and the lateral openings 13 of the deion chamber 8, a portion of the gases is already discharged into the expansion spaces with the openings 14 prior to entering the deion chamber. The gases from the lateral recesses 13 and the front opening 12 of the deion chamber 8 are supplied to the inflow openings 9 due to their stronger heating after the arc splitting and the deflection between the vulcanized fiber plate and the half-shell plastic injection-molded part 22.

Due to these longer paths, the gases already experience cooling at the metallic electrodes 1 and 2, the electrode leads respectively.

FIG. 4 shows the expansion area 26 for the discharged gases. The expansion area 26 is located between the plastic injection-molded part 22 and the outer vulcanized fiber plate 23.

The openings 9 and 14 for the gas supply open into this space as well.

The gases are deflected using a splitter 16 (see FIG. 3). The splitter 16 simultaneously prevents contaminants from being returned via the outlet opening 10.

The splitter 16 with its explained effect in regard to deflecting and distributing hot gases and preventing combustion products from being introduced is advantageous in realizing the desired compact design. Despite the short paths between the outlet openings of the deion chamber and the recesses in the electrodes 6, the splitter enables gas to be returned without expensive measures. The splitter moreover ensures sufficient cooling and deionization so that no re-ignitions will occur and the follow current arc is supported in its movement.

The position of the deion chamber 8 and the horn electrodes 1 and 2 is outlined in the active area of the spark gap in the respective representation.

The lead-throughs 15 are provided for riveting the individual components.

FIG. 4 shows a cross-section of an embodiment of the horn spark gap according to the invention.

The deion chamber 8 has a continuous longitudinal web 24 next to the transverse web 25 in the outflow area. Said web 24 serves to ensure flow dynamics on both sides so that backflow does not occur only on one side. Uniform cooling of the gases and better utilization of the heat capacity of the encapsulated spark gap are thereby achieved. In principle, however, unilateral flow guidance is also conceivable.

The gases which are guided through the deion chamber 8 and highly heated are split up on each side by a splitter 16 (see FIG. 3) located in the expansion space 25 prior to being directly supplied to the deion chamber 8 via the recesses 6 of electrode 1.

As noted above, the splitters 16 at the same time prevent combustion products from being directly introduced. Re-ignition is thereby prevented.

The lateral flow-off channels 14 of the deion chamber 8 in the inlet area, where the gas is still relatively cold, are directly ventilated downward into the flow circulation in the direction of the splitter. This results in a short flow path having low flow resistance.

The lateral flow-off channels 13 of the deion chamber 8 are ventilated upward in the direction of the outflow area of the deion chamber via separate channels 27. Thereby, these hot gases are more strongly cooled over a longer flow path. The ventilation openings of the deion chamber, i.e. the openings 12, 13 and 14, can be provided between every single deion plate which has a V-shaped portion or else be realized in unilateral staggering between every second plate. The ventilation openings of the deion chamber can be individually adapted according to the given space conditions and the desired performance parameters.

In the event of the spark gap ageing after numerous loads, a change in behavior can be recognized by an optical display or error message respectively.

Because of its small size, it makes sense to realize the simplest and most cost-efficient monitoring of the gap status as possible. A characteristic parameter for an imminent overload of the spark gap is usually the temperature in the ignition region of the arc at the electrodes 1 or 2, at the flyback site B of the arc at the electrode 2, or the temperature at the deion chamber. A temperature-sensitive material, e.g. a solder preform or a wax part exposed to pressure or shearing action by means of spring preload can be set on the respective areas for temperature control. The temperature-sensitive material can alternatively be positioned at thermally well-coupled connection parts of the electrodes 1 or 2. Thus, there is the option of disposing the solder preform in direct contact with the lead 7 which is in turn directly connected to the electrode 1.

When the respective limit temperature of the preform is reached, a mechanical display element will be actuated or triggered subsequent deformation such as e.g. compression or expansion, melting or shearing. The heating of individual parts requires a certain time, and namely because of the given heat conductance or existing heat capacities. In order to detect rapid dynamic processes induced in particular by pulse currents, monitoring of pressure or force can be used for a display.

The arc pressure in the travel path, the dynamic pressure in the area of the arc quenching chamber, particularly above the gas deflection area, or else the gas pressure within the gas expansion area are suited for this purpose. The outer insulating plate of the respective chamber can in practice be used as a membrane for pressure measurement. Predetermined mechanical breaking points can likewise be installed in these areas which actuate a display as of a certain pressure level or also simultaneously contribute to relieving pressure at high overloads so as to provide burst protection.

LIST OF REFERENCE NUMERALS

1 long electrode
2 short electrode
3 circuit board
4 ignition site
5 ignition region
6 recesses in electrodes 1 and 2
7 connecting lead to long electrode 1
8 deion chamber
9 outflow openings in the electrode region
10 outflow opening in the short electrode
11 arc travel path
12 rear outflow openings of the deion chamber
13 lateral outflow openings of the deion chamber
14 outflow opening in the region of the inlet area
15 lead-throughs
16 splitter
20 inner vulcanized fiber plate
21 ferromagnetic material
22 plastic injection-molded part
23 outer vulcanized fiber plate
24 transverse web
25 longitudinal web
26 expansion area
27 recess in the insulating area of the deion chamber

The invention claimed is:

1. A horn spark gap with a deion chamber of a non-blowout design having a multi-part insulating housing as a supporting and accommodating body for the horn electrodes and the deion chamber as well as means for conducting the arc-induced gas flow, wherein the insulating housing is divided in the plane spanned by the horn electrodes and forms a first and a second half-shell, characterized in that the horn electrodes have an asymmetrical form comprising a longer and a shorter electrode, wherein both electrodes extend almost in parallel or with a small divergence in the ignition region, the arc travel path between the electrodes is delimited in the direction of the deion chamber by a plate-shaped insulating material, wherein the plate-shaped insulating material is inserted into a respective first shaped portion of the respective half-shell in a form-fitting manner, the first shaped portions furthermore accommodate a ferromagnetic deposit of the arc travel path, wherein the plate-shaped insulating material electrically isolates the respective deposit from the electrodes, the half-shells have further second shaped portions which accommodate an insertable deion chamber part in a form-fitting manner, wherein apertures or openings in the respective half-shell are located between the respective first and second shaped portions and the shorter electrode ends in front of the deion chamber part, with the result that the gas flow only passes partially into the deion chamber.

2. The horn spark gap according to claim 1,
characterized in that
the horn spark gap has a sandwich construction and the half-shells are joined in a force-fitting manner by screws or rivets.

3. The horn spark gap according to claim 1,
characterized in that
the exterior sides of the half-shells facing away from the electrodes each have a third shaped portion at least in the area of the apertures or openings which accommodates an outer insulating plate in a form-fitting manner.

4. The horn spark gap according to claim 3,
characterized in that
the third shaped portion exhibits a web or a splitter for dividing the gas flow, wherein the section formed by the third shaped portion and the outer insulating plate creates a gas expansion space.

5. The horn spark gap according to claim 4,
characterized in that
the gas expansion space exhibits a slit-shaped passage gap for conducting the gases back to the arc combustion chamber, wherein the electrodes have openings or flybacks above the ignition region to assist in the propelling of the arc by the gas flow.

6. The horn spark gap according to claim 1,
characterized in that
the current supply to the longer electrode is guided to be antiparallel over a section as large as possible.

7. The horn spark gap according to claim 1,
characterized in that
the shorter electrode has high impedance.

8. The horn spark gap according to claim 1,
characterized in that
the igniting or triggering ensues via a flexible circuit board having a conductor portion which is introduced into the ignition region between the electrodes.

9. The horn spark gap according to claim 1,
characterized in that
same has an error condition display having a spring-biased shaped part which melts or becomes dimensionally unstable at excess temperature.

10. The horn spark gap according to claim 3,
characterized in that
the outer insulating plate deforming at pressure load is operatively connected to a sensor system for detecting abnormal operating states.

11. The horn spark gap according claim 1,
characterized in that
same forms a universal module having exterior connecting terminals for the electrodes which can be integrated into a connector part or outer housing according to customer request.

* * * * *